US008166671B2

(12) United States Patent
Frederick

(10) Patent No.: US 8,166,671 B2
(45) Date of Patent: May 1, 2012

(54) ADJUSTABLE SHOCK ATTENUATING MEANS FOR FOOTWEAR AND FOOTWEAR USING THE SAME

(75) Inventor: Edward Frederick, Brentwood, NH (US)

(73) Assignee: Li-ning Sports (Shanghai) Co., Ltd., Shanghai (CN)

( * ) Notice: Subject to any disclaimer, the term of this patent is extended or adjusted under 35 U.S.C. 154(b) by 970 days.

(21) Appl. No.: 12/097,989

(22) PCT Filed: May 26, 2006

(86) PCT No.: PCT/CN2006/001109

§ 371 (c)(1),
(2), (4) Date: Jun. 18, 2008

(87) PCT Pub. No.: WO2007/115442

PCT Pub. Date: Oct. 18, 2007

(65) Prior Publication Data

US 2008/0256830 A1 Oct. 23, 2008

(30) Foreign Application Priority Data

Mar. 30, 2006 (CN) ..... 2006 2 0040655 U

(51) Int. Cl.
*A43B 13/28* (2006.01)
*A43B 13/18* (2006.01)

(52) U.S. Cl. ..... 36/27; 36/28; 36/35 R; 36/37

(58) Field of Classification Search ..... 36/27, 28, 36/35 R, 37, 38, 7.8
See application file for complete search history.

(56) References Cited

U.S. PATENT DOCUMENTS

| | | | | |
|---|---|---|---|---|
| 4,843,737 | A | 7/1989 | Vorderer | |
| 4,894,934 | A * | 1/1990 | Illustrato | 36/37 |
| 5,400,528 | A | 3/1995 | Skinner et al. | |
| 5,643,148 | A | 7/1997 | Naville | |
| 6,318,001 | B1 | 11/2001 | Lee | |
| 7,314,125 | B2 * | 1/2008 | Smaldone et al. | 188/372 |
| 7,730,635 | B2 * | 6/2010 | Aveni et al. | 36/27 |
| 2006/0065499 | A1 * | 3/2006 | Smaldone et al. | 188/372 |

FOREIGN PATENT DOCUMENTS

| | | | |
|---|---|---|---|
| CN | 1132054 | A | 10/1996 |
| CN | 2262353 | Y | 9/1997 |
| CN | 2501339 | Y | 7/2002 |
| EP | 0 875 164 | B1 | 11/1998 |
| WO | WO 92/08383 | A1 | 5/1992 |

* cited by examiner

*Primary Examiner* — Marie Patterson
(74) *Attorney, Agent, or Firm* — Arent Fox LLP

(57) ABSTRACT

An adjustable shock attenuating means comprises at least one arch element (1) and at least one tensile element (2) arranged between any two positions at a concave surface of the element (1) or between two ends of the arch element (1). This means further comprises at least one additional arch element (12) arranged intersecting with the arch element (1) or arranged with the arch element (1) side by side. The arch element (1) has a U-shaped cut-out (13, 14) at its two ends respectively and the tensile element (2) correspondingly has a connecting piece (23, 24) at its two ends respectively to be coupled with the U-shaped cut-outs (13, 14) of the arch element (1) with which the tensile element (2) is coupled with the arch element (1).

19 Claims, 4 Drawing Sheets

ADJUSTABLE SHOCK ATTENUATING MEANS FOR FOOTWEAR AND FOOTWEAR USING THE SAME

CROSS-REFERENCE TO RELATED APPLICATION

This is a National Stage entry of International Application No. PCT/CN2006/001109, filed May 26, 2006. The disclosure of the prior application is hereby incorporated herein in its entirety by reference.

FIELD OF THE INVENTION

The present invention relates to an adjustable shock attenuating means for footwear and footwear using the same. In particular, the invention can be used to create a shock attenuating system with fixed properties or with properties that can be adjusted to accommodate the shock absorbing needs of the individual or the specific mechanical requirements of a particular activity or intensity of activity.

BACKGROUND OF THE INVENTION

The impact forces that must be attenuated by an article of footwear vary considerably between individuals and within individuals depending on the type of activity and the intensity and duration of the activity undertaken by the individual. For example, a large population of individuals sharing the same shoe size such as US Men's size 9 can vary in body mass from 50 kg to over 100 kg. Also that same group of individuals may practice a range of sports or work activities while wearing a give type of shoe, or they may practice these activities at a wide range of intensities. Biomechanical research has shown that the impact forces experienced underfoot are highly dependent on the type and intensity of the activity and on the mass of the individual participant. Therefore an article of footwear produced in a given size may be required to attenuate impact forces as low as a few hundred Newtons of force or as high as several thousand Newtons. Conventional foam materials and other materials used to attenuate impact forces in footwear are not fully functional over such a wide range.

Therefore a shock attenuating technology must either be capable of being precisely engineered to meet the requirements of a particular individual as well as the particular impact forces experienced as a consequence of undertaking a particular activity, or, the technology must be adjustable either passively or actively in response to the load or the expected load. Passively adjusting shock attenuation requires that the system adjust itself without the intervention of the individual. Active adjustment requires that the individual or, some other agent uses some means of adjustment to change the properties of the shock attenuating system.

Therefore, it is needed to produce a shock absorbing system precisely engineered to absorb a specified but limited range of impact shock magnitudes or to create passively or actively adjustable systems that can be adjusted over a wider range. In the case of the fixed system, the shock attenuating properties may be engineered for individuals of a particular range of body masses, or, for certain limited and defined activities.

An adjustable version of such a need may be used to adjust or fine tune the shock attenuating response to match the specific requirements of the individual or activity, or, to accommodate changing shock attenuating demands caused by different environmental conditions.

Therefore, it is needed to provide the following two factors:

1: a shock attenuating technology that can be precisely engineered to produce a wide-range of shock attenuating properties.

2: a shock attenuating technology that is inherently adjustable in terms of its mechanical properties so that it may be used to produce cushioning systems that can be precisely adjusted to provide a wide-range of shock attenuating properties.

An arch is one of the most efficient load bearing structures. It provides relatively greater stiffness for load bearing per mass or thickness than other structures. When the arch is used as a cushioning structure, however, it must be able to flex to provide compliance, a necessary feature of all cushioning systems. However, when an arch is made to be compliant when subjected to a given load it tends to be slow to return to its initial shape, and it is susceptible to buckling. This can be helped by the selection of materials that are resilient and tend to retain their shape, but these materials are also less compliant and therefore less able to provide adequate shock attenuation. By itself the arch is not able to provide all the properties required of a shock attenuating system.

Likewise, resilient elastic materials are good at absorbing and returning energy and deforming under load, but generally they do not have enough structural integrity to provide all the properties required of a shock attenuating system.

SUMMARY OF THE INVENTION

To solve the above problems in the prior art, it is an object of the present invention to provide a shock attenuating means that can provide a shock attenuating system with good shock attenuating properties by combining a shock absorbing arch with a tensile member made of elastic materials.

It is another object of the present invention to provide footwear equipped with said shock attenuating means that can effectively attenuate impact shock under the foot during sport activities.

In accordance with one aspect, the present invention provides an adjustable shock attenuating means for footwear, comprising: at least one arch element; and at least one tensile element arranged between any two positions at a concave surface of the arch element or between two ends of the arch element.

According to one embodiment of the invention, the arch element has a U-shaped cut-out at its two ends respectively and the tensile element correspondingly has a connecting piece at its two ends respectively to be coupled with the U-shaped cut-outs of the arch element.

According to another embodiment of the invention, the arch element has a U-shaped cut-out at its one end and a longitudinal groove at the other end thereof with at least two lateral depressions provided on the outer surface of this end.

According to another embodiment of the invention, the shock attenuating means further comprises at least one additional arch element arranged intersecting with the arch element.

According to another embodiment of the invention, the shock attenuating means further comprises at least one additional arch element arranged with the arch element side by side.

According to a further embodiment of the invention, the arch element is Y-shaped. In this case, the tensile element is arranged between at least two sections of three sections of the Y-shaped arch element at its concave surface.

In accordance with another aspect, the present invention provides footwear which comprises the above adjustable shock attenuating means arranged at any part of the sole underlying the plantar surface of the foot.

In one embodiment of the invention, the footwear has a hollow base in its heel region. The upper portion of the base is coupled with a sole and the shock attenuating means is arranged in a cavity of the hollow base.

An arch made from a relatively rigid material is used to distribute any load applied to the topmost portion of the arch and to flex under application of such a load, in such a way as to function as a shock attenuating structure.

The tensile element increases the resiliency of the overall tensile-arch structure, and also increases the overall stiffness of the combined tensile-arch structure. When a tensile-arch structure is used as described herein, and a load is applied to the peak of the arch, to its base, or over the external surface of the crossing-arch, the load applied is shared by flexing of the rigid portion of the arch and by a concomitant stretching of the tensile element. In this way, both the flexing of the arch and the stretching of the tensile element contribute to the shock attenuating capacity of the tensile-arch structure.

The advantages of a tensile-arch structure as a shock attenuating device are several: less weight for a given functional arch stiffness; more resilient; potential for variable stiffness by adjustment or replacement of the tensile element; use of linearly elastic tensile element provides for linearly increasing stiffness in response to increased loading of the tensile arch structure; use of both flexing of the arch and stretching of a tensile element to attenuate impact forces; and resistance to buckling of the arch structure under compressive loads.

Due to combination of two or more crossing and/or paralleling arch element, the attenuating shock means according to the invention can make the arch element and tensile element absorb more impact energy. Consequently the process of attenuating shock is completed and the overall structure becomes more resilient. Moreover, the crossing structure possesses enough structural integrity in order to provide fully required shock attenuating system.

BRIEF DESCRIPTION OF THE FIGURES

The accompanying drawings, which are incorporated in and constitute a part of this specification, illustrate embodiments of the invention and together with the description, serve to explain the principles of the invention.

DETAILED EMBODIMENTS OF THE INVENTION

Figure 1:
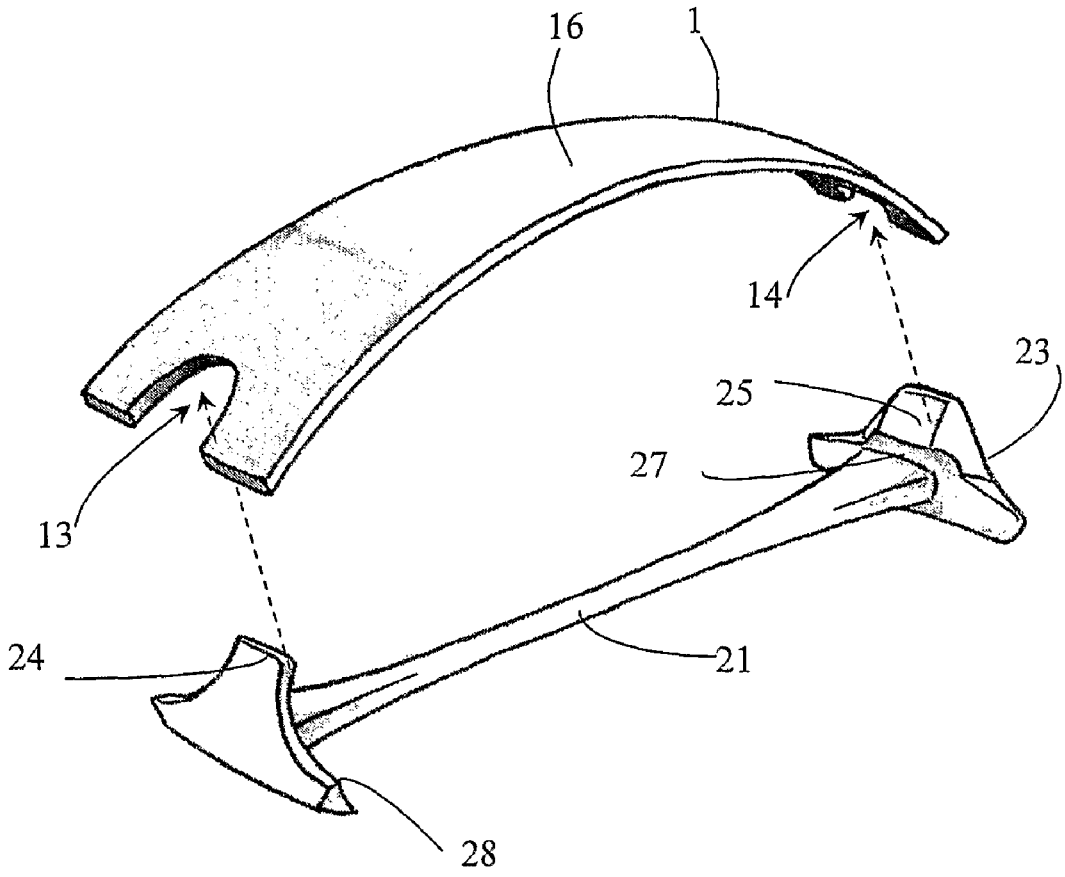
FIG. 1 is a perspective view showing the first embodiment of the shock attenuating means according to the invention.
Figure 2:
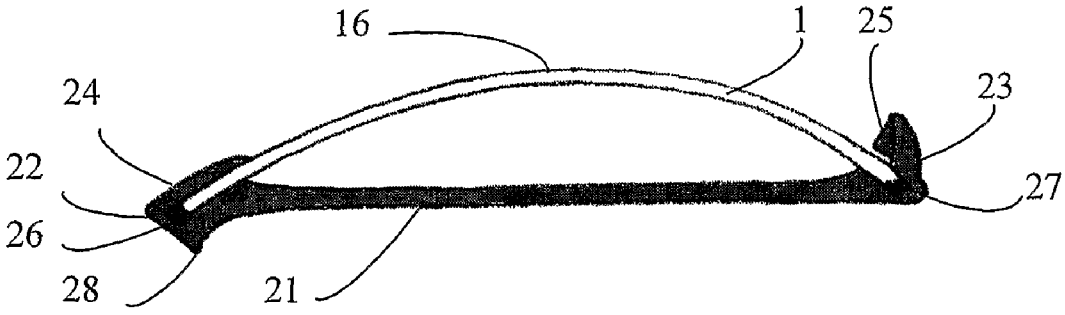
FIG. 2 is a perspective view showing the tensile element according to the invention.

As shown in FIG. 1 and FIG. 2, the invention provides a shock attenuating means which comprises: an arch element 1 and a tensile element 2 arranged between any two positions at a concave surface of the arch element 1 or between two ends of the arch element 1. The arch element 1 is implemented by a curved structure which is formed of a panel made from relatively stiff material and bended into a shape of semi-circle or a half ellipse. U-shaped cut-outs 13 and 14 are provided at the ends of the arch element 1, respectively. Depth of the U-shaped cut-outs is generally set such that one cut-out is deeper than the other. In this embodiment, U-shaped cut-out 13 is deeper than cut-out 14.

Tensile element 2 is an elongated structure made from elastic material and comprises an elongated tensile cable 21 and two connecting pieces 22 and 23 which are provided at both ends of the tensile cable 21 and integral with the tensile cable 21. Preferably, the tensile cable 21 can further includes a reinforced tendon (not shown) therein. This reinforced tendon is used to increase the elasticity and flexibility of the tensile element 2 and can have a slim body with any cross-section. The upper surface 24 of the connecting piece 22 extends inwardly to form a slot 26 which has a complementary shape with the U-shaped cut-out 13 and used to couple with the U-shaped cut-out 13 of the arch element 1. Similarly, the upper surface 25 of the connecting piece 23 extends slightly inward to form a slot 27 that is used to couple with the U-shaped cut-out 14 of the arch element 1. Since the U-shaped cut-out 13 is deeper than cut-out 14, the depth of the slot 26 is accordingly deeper than that of slot 27. The initial length of the tensile element 2 is shorter than the linear length of the arch element 1. When assembled, cut-outs 13, 14 of the arch element 1 are inserted into slots 26, 27 at both ends of the tensile element 2, respectively. Because the initial length of the tensile element 2 is shorter than the linear length of the arch element 1, a pre-load is applied to the tensile element 2. This will insure that the arch element 1 can, not only immediately make a response to any load when applied but also make a response in a consistent and mechanically desirable way in each cycle of loading and unloading.

Such a combination of the arch element 1 with the tensile element 2 can be used to produce a tensile force between both sides of the arch element 1 so as to increase the bending stiffness of the arch element 1 which would be smaller than that without the addition of a tensile member. The tensile element 2 also serves to make the overall structure more resilient and to enhance the integrity of the tensile-arch structure.

In such way, the tensile element 2 which is under tension can also applying tension to the arch element 1 all the time. This ensures that the tensile element 2 is being stretched though the linear portion of its tension-length curve when it is dynamically loaded as the arch flexes under load and tends to further stretch the tensile element 2.

There are various connecting manner to couple the arch element 1 with the tensile element 2. For example, both ends of the arch element 1 can have a hole respectively through which the tensile element 2 is coupled with the arch element 1.

Furthermore, the tensile element 2 may span the arch element 1 at any level from the peak of the arch element to the base at both sides of the arch element 1. The tensile element 2 may span the arch element 1 symmetrically with both attachments to the arch element at the same or a similar level or, asymmetrically with one point of attachment higher or lower than the other. Preferably, the tensile element 2 spans and extends the arch 1 as shown in FIG. 1.

Figure 3:
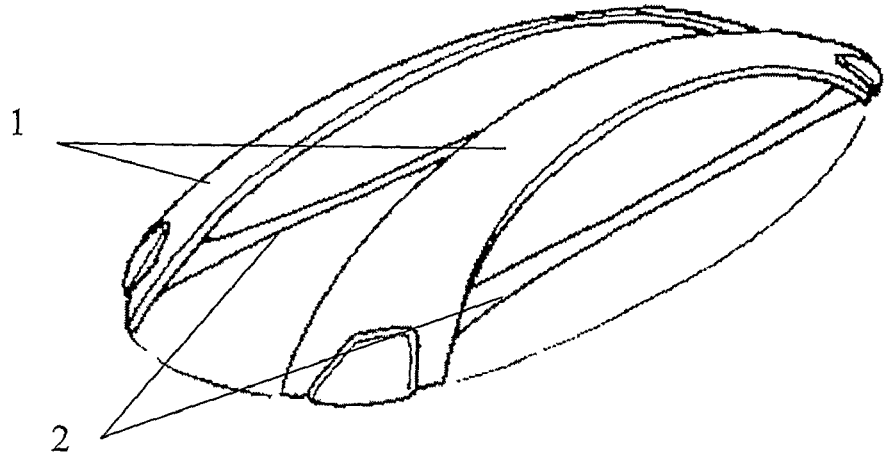
FIG. 3 is a perspective view showing the second embodiment of the shock attenuating means according to the invention.

FIG. 3 shows the second embodiment of the present invention. As shown in FIG. 3, two tensile elements 2 are arranged to span the entire arch element 1. Certainly, more tensile elements 2 may be arranged to span the entire arch element 1 or only span some parts of the arch element 1.

Figure 4:
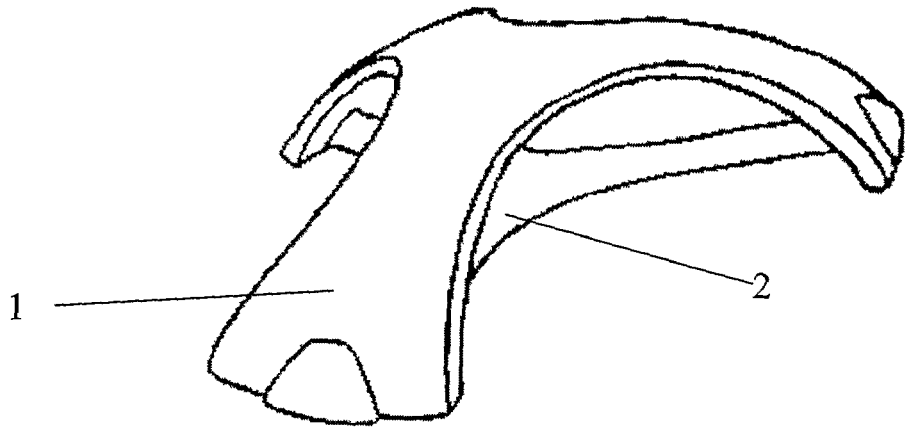
FIG. 4 is a perspective view showing the third embodiment of the shock attenuating means according to the invention.

According to the third embodiment of the present invention, the arch element 1 may be formed as various shapes. As shown in FIG. 4, the arch element 1 is formed as a Y-shape structure and the tensile element 2 is correspondingly formed as a Y-shape to match the shape of the arch element 1.

Figure 5:
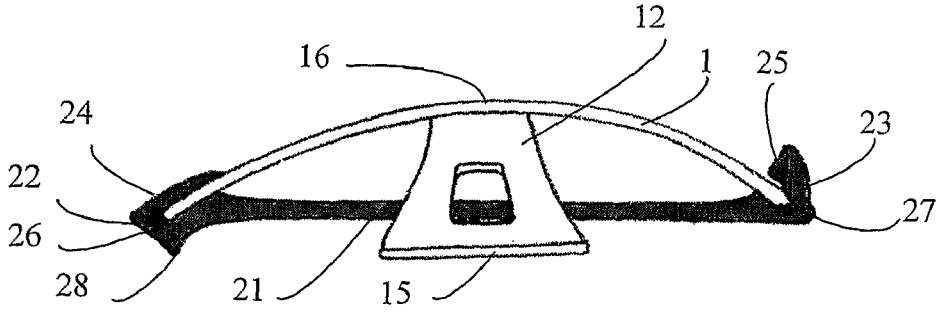
FIG. 5 is a perspective view showing the fourth embodiment of the shock attenuating means according to the invention.

According to the fourth embodiment of the present invention as shown in FIG. 5, another arch element 12 is provided under the arch element 1. The two arch elements 1, 12 may be integrated into one piece through, for example, injection molding. Alternatively, the arch elements 1, 12 may be prepared separately. In latter case, the two separately prepared arch elements can be coupled to an outside object (such as sole) around the shock attenuating means no matter the manner via which the two arch elements are coupled with each other (such as via a detachable or fixed couple). The two arch elements 1, 12 are arranged to intersecting with each other in a horizontal plane, preferably, intersecting in shape of criss-cross. The arch elements 1, 12 are intersected at their midpoint or approximate midpoint. Curvature of the two arch elements may be same or not. Preferably, curvature of arch element 1 with the tensile element 2 provided thereon is less than that of the arch element 12.

A support foot 15 extends outward from both bottom ends of the arch element 12, respectively. A flange (not shown) is arranged at both inner edges of the bottom surface of the arch element 12 to extend along the ends of the arch element 12. The vertical height from the bottom of the arch element 1 is higher than that of arch element 12. That is to say, the support foot 15 provided on the bottom surface of the arch element 12 contacts with a supporting surface such as sole and the bottom surface of the arch element 1 is above the supporting surface. The bottom end of the connecting piece 22 of tensile element 2 arranged on the arch element 1 is further provided with a projection 28. When the tensile element 2 is coupled with the arch element 1, the projection 28 of the connecting piece 22 and the support feet 15 of the arch element 12 are located on the same horizontal plane.

According to the present invention, the tensile element 2 may be coupled with the arch element 1 or with the arch element 12 or with the both. Combination of the two arch elements 1, 12 is able to convert more impact energy into elastic energy stored in arch elements 1 and tensile element 2 so that the attenuating process is accomplished and overall structure becomes more resilient. Such a combination can also attenuate the loads applied on the arch elements 1, 12 in various orientations. Furthermore, the overlapping intersecting arrangement according to the invention has enough structural integrity to provide all the properties required for a shock attenuating system.

Figure 6:
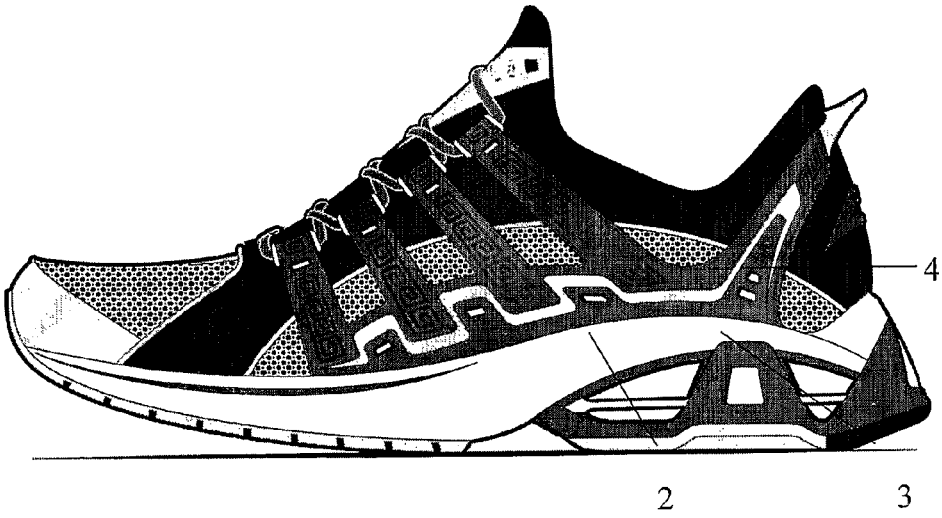
FIG. 6 is a schematic view showing the shock attenuating means at the heel region according to the invention.

The shock attenuating means according to the invention can be used as a shock attenuating structure by itself, or, in combination with other shock attenuating materials or structures. The tensile-arch structure can be incorporated into the sole of the shoe. Furthermore, this shock attenuating means may be arranged in the heel region or in the forefoot region or in any part of the sole underlying the plantar surface of the foot. In an embodiment of the present invention as shown in FIG. 6, the shock attenuating means is arranged at the heel region. In this embodiment, the footwear has a base 3 in its heel region. The base 3 is hollow and approximately boat-shaped. The bottom of said base 3 is the bottom of the heel that locates in the same horizontal plane with the forefoot. The upper portion of the base 3 is coupled with a sole 4 and the shock attenuating means is arranged in a cavity of the hollow base 3. In this case, one end of the tensile element 2 is fixed to the front end of the base 3 which is in proximity to the forefoot, and the other end is detachably coupled to the back end of base 3 which is in proximity to the heel.

Figure 7:
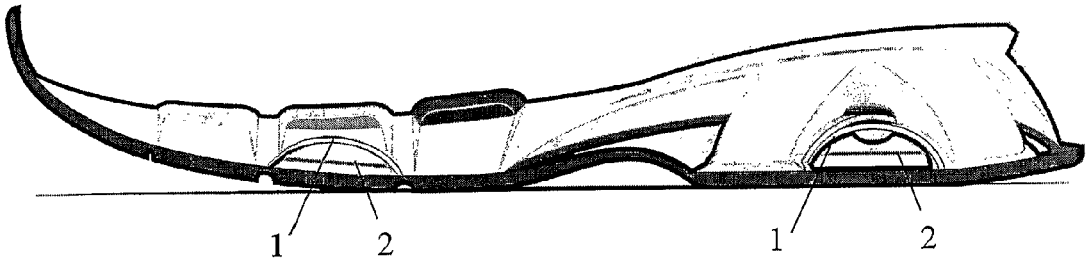
FIG. 7 is a schematic view showing the shock attenuating means at the forefoot and heel region according to the invention.

As shown in FIG. 7 illustrating one embodiment of the present invention, the shock attenuating means may be arranged both at the forefoot and at the heel region of the footwear.

Figure 8:
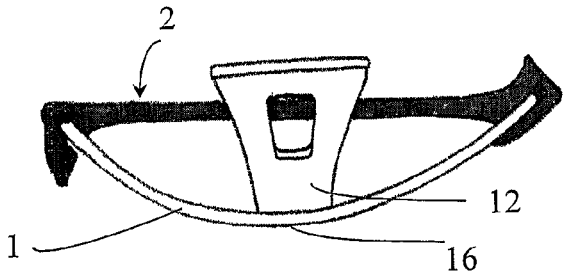
FIG. 8 is a schematic view showing another embodiment of shock attenuating means according to the invention in use.

As shown in FIG. 8 illustrating another embodiment of the present invention, when installed, the shock attenuating means may be arranged upside down with its peak 16 nearest the ground.

The shock attenuating means may be arranged in the footwear in various manners including but not limited to: several shock attenuating means being arranged in a same shoe; all the peaks 16 being arranged nearest the foot or ground; peaks 16 being arranged alternately upside down and right-side up; or various combinations of the upside down and right-side up.

A plurality of the attenuating shock means may also be used in an overlapping intersecting arrangement to provide additional shock attenuation efficiency.

Figure 9A:
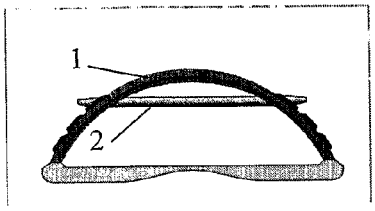
FIGS. 9*a*-9*d* is a perspective view showing the fifth embodiment of the shock attenuating means according to the invention.
Figure 9B:
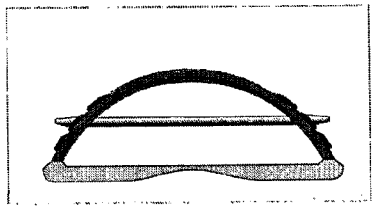
Figure 9C:
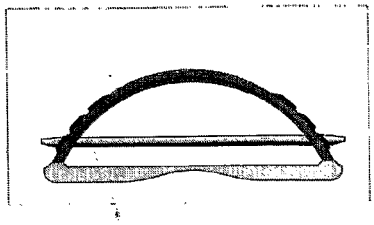
Figure 9D:
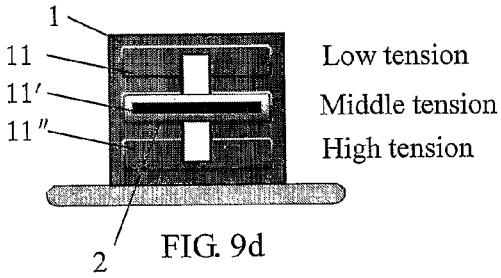

According to another embodiment of the present invention, one or more tensile element(s) 12 is adjustable in such a way that the tension thereof can be increased or decreased. Such an adjustable tension might be accomplished by moving the connection point of the tensile element 2 to one end of the arch element 1, or synchronously moving two connection points of the tensile element 2 to both ends of the arch element 1 to make the tensile element 2 close to or away from the peak 16 of the arch element 1. Such an adjustable tension might also be accomplished by arranging several tensile elements 2 at the arch element 1, by arranging several tensile elements 2 with different size or tensile properties, or by different combinations thereof. Such an adjustable tension might further be accomplished by the use of a mechanical tensioning device, or any other means by which the length or stiffness of the tensile element may be adjusted. Such an adjustable tension may be controlled by a user or another party, or they may be automatically controlled by the use of mechanical actuators or other devices capable of affecting a tension adjustment. In the embodiment as shown in FIG. 9*d*, a longitudinal groove is provided at one end of the arch element 1 with three lateral depressions 11, 11' and 11" provided on the outer surface of the arch element 1 fixed to heel. When movable end 23 of the tensile element 2 is placed on the topmost depression 11 (as shown in FIG. 9*a*), the tensile element 2 is stretched in low tension configuration because the movable end 23 is positioned closest to the peak 16 of the arch element 1. Likewise, when the movable end 23 of the tensile element 2 is placed on the bottom depression 11" (as shown in FIG. 9*c*), the tensile element 2 is stretched in high tension configuration because the movable end is positioned farther to the peak 16 of arch element 1. Here, it should be appreciated that, except for the adjustment manner as described above, any other adjustable structure known to the skilled in the art can also be used.

Figure 10:
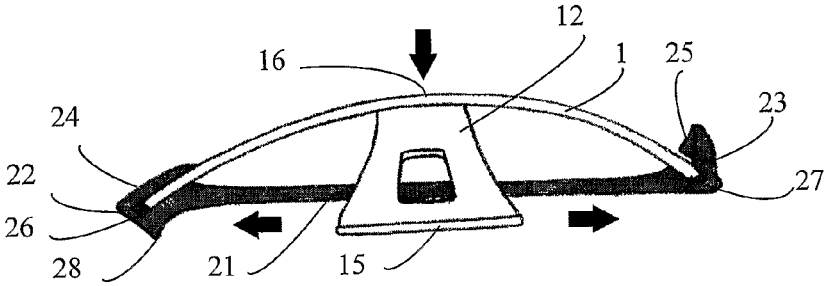
FIG. 10 is a schematic view illustrating the force being borne by both the tensile element and the arch and the status that the tensile-arch structure resists a lateral displacement toward both sides of the arch, when the shock attenuating means is under a load.

FIG. 10 shows the stress borne by both the tensile element 2 and the arch element 1 and the tensile-arch structure resisting a lateral displacement of the arch element 1, when the shock attenuating means according to the invention is applied a load. In particular, when the peak 16 of arch 1 is subjected to a pressure (as shown by a vertical arrow), the combined arch element 1, 12 is accordingly flexed and thus results in a lateral displacement (as shown by the horizontal arrow). Elastic energy stored in the tensile element applies a tensile force that tends to pull the ends of the arch element 1 toward one another. The use of the tensile element 2 in this way can resist the tendency for the ends of the arch element 1 to displace laterally when the arch is loaded statically or dynamically.

Figure 11:
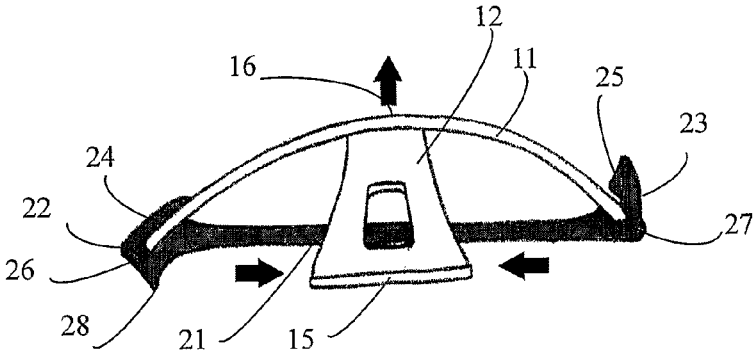
FIG. 11 is a schematic view illustrating the status that tensile element and arch element come back to their initial position, after the shock attenuating means is unloaded.

FIG. 11 shows that the tensile element 2 and the arch element 1 come back to their initial status after the load applied to the shock attenuating means according to the invention is released Release of the pressure applied on the peak 16 of the arch element 1 breaks mechanical balance existed among the load, the arch element 1 and the tensile element 2. At this time, material properties of the arch element 1 provide a tendency of returning to the arch element's initial status and the elastic energy stored in the tensile element 2 can release tensile force to intensify said tendency. Consequently, under the resiliency of the overall tensile-arch structure, the lateral displacement tends to return to its initial status (as shown by the horizontal arrow). Meanwhile, height of the arch element 1 will be accordingly increased as the tensile-arch structure returns to its initial status (as shown by the vertical arrow).

It can be understood from aforesaid description that, an arch element 1 made from a relatively rigid material is used to distribute any load applied to the topmost portion 16 of the arch element 1 and can be flexed under application of such a load so as to function as a shock attenuating component. The arch element 1 may be made from metal or from composite materials such as carbon-Kevlar or Fiberglas, from rigid molded materials such as thermoplastic urethane, nylon, Pebax, or from any other material sufficiently strong and rigid for this application.

The shock attenuating means according to the invention may also adopt a tensile element 2 with an adjustable characteristic, or a tensile element 2 with such a characteristic that it can be instantaneously increased or decreased in response to the load applied or the rate of loading. Such a dynamic characteristic or substantially an instantaneous adaptation characteristic is a result of the physical properties of some or all of the materials forming the tensile element. Such an automatic adjustment or adaptation in tensile stiffness could be created by using rate-sensitive or load-sensitive materials as a component of the tensile element structure.

For example, such an automatic, dynamic adjustment or adaptation in tension could be created by using rate-sensitive or load-sensitive materials as following: rheopectic materials, viscoelastic materials, dilatant or shear-thickening materials, pseudoplastic materials, and thixotropic materials. The above listed materials having non-Newtonian physical properties should be understood as illustrative but not comprehensive. The skilled in the art would appreciate that any materials with rate-sensitive or load-sensitive characteristic in response to a tensile load could be incorporated into the tensile element 2, or used to create a tensile element 2 with dynamically adapting stiffness in response to load or rate of loading.

The arch element made from relatively stiff materials forms a load bearing and load distributing yet compliant structure that behaves as an area elastic structure as it deforms, distributes and absorbs the energy of an impact. Area elastic structures distribute forces over their surface and deform over the entire surface in response to a load applied to a small or large area of the structure.

The relatively elastic and tensile structure is used with the arch element to control the rate of deformation and stiffness of the combined structure. Moreover, it also helps to make the arch element to return to its initial status after each cycle of compression and thereby counteract the tendency of the arch to permanently or temporarily deform when subjected to repeated impact cycles.

What is claimed is:

1. An adjustable shock attenuating means for footwear comprising:

at least one arch element (1); and at least one tensile element (2) arranged between any two positions at a concave surface of the arch element (1) or between two ends of the arch element (1), wherein the at least one arch element has a U-shaped cut-out (13) at a first end and a longitudinal groove at a second end with at least two lateral depressions provided on an outer surface of the second end.

2. The adjustable shock attenuating means for footwear according to claim 1, further comprises at least one additional arch element (12) arranged intersecting with the at least one arch element (1).

3. The adjustable shock attenuating means for footwear according to claim 1, further comprises at least one additional arch element (12) arranged with the at least one arch element (1) side by side.

4. The adjustable shock attenuating means for footwear according to claim 1, wherein the at least one arch element (1) is Y-shaped and the tensile element (2) is arranged between at least two sections of three sections of the at least one arch element (1) at a concave surface thereof.

5. The adjustable shock attenuating means for footwear according to claim 1, wherein the at least one arch element (1) has a U-shaped cut-out (13, 14) at two ends thereof.

6. The adjustable shock attenuating means for footwear according to claim 5, wherein the tensile element (2) correspondingly has a connecting piece (23, 24) at two ends, respectively, to be coupled with the U-shaped cut-outs (13, 14) of the at least one arch element (1).

7. The adjustable shock attenuating means for footwear according to claim 6, wherein the initial length of the tensile element (2) is shorter than the linear length of the at least one arch element (1).

8. The adjustable shock attenuating means for footwear according to claim 7, wherein the tensile element (2) further comprises a reinforced tendon therein.

9. The adjustable shock attenuating means for footwear according to claim 1, wherein the tensile element (2) comprises materials selected from the group consisting of: rheopectic materials, viscoelastic materials, dilatant or shear-thickening materials, pseudoplastic materials, and thixotropic materials.

10. The adjustable shock attenuating means for footwear according to claim 1, wherein the at least one arch element (1) is made of materials with rigidity and stiffness.

11. The adjustable shock attenuating means for footwear according to claim 10, wherein said materials with rigidity and stiffness include metal or composite materials, or rigid molded materials.

12. The adjustable shock attenuating means for footwear according to claim 11, wherein said materials are composite materials and said composite materials are selected from the group consisting of: a carbon-para-aramid synthetic fiber and Fiberglas.

13. A type of footwear comprises the adjustable shock attenuating means according to claim 1, arranged at any part of the sole underlying the plantar surface of the foot.

14. The footwear according to claim 13, wherein the shock attenuating means is arranged in a heel region and/or a forefoot region of the footwear.

15. The footwear according to claim 14, wherein the footwear has a hollow base (3) in a heel region, the upper portion of the base (3) is coupled with a sole (4), and the shock attenuating means is arranged in a cavity of the hollow base (3).

16. The footwear according to claim 15, wherein one end (22) of the tensile element (2) is fixed to an end of the base (3) near the forefoot region and the other end thereof is detachably fixed to another end of the base (3) near the heel region.

17. The footwear according to claim 16, wherein the shock attenuating means further comprises at least one additional arch element (12) arranged intersecting with the at least one arch element (1) or arranged with the at least one arch element (1) side by side, the vertical height from the bottom of the at least one arch element (1) is higher than that of the at least one additional arch element (12); a support foot (15) horizontally extends outward from the bottom surface of the at least one additional arch element (12), respectively; the support foot (15) and the base (3) are located on the same horizontal plane.

18. The footwear according to any one of claims 13-17, wherein the shock attenuating means is arranged in the footwear upside down with the peak (16) of the at least one arch element (1) nearest the ground.

19. The adjustable shock attenuating means for footwear according to claim 11, wherein said rigid molded materials is selected from the group consisting of: thermoplastic urethane, nylon and a polyether block amide.

* * * * *